United States Patent [19]

Carlson

[11] Patent Number: 4,594,793

[45] Date of Patent: Jun. 17, 1986

[54] DRYING OF PULVERIZED MATERIAL WITH HEATED CONDENSIBLE VAPOR

[75] Inventor: Larry W. Carlson, Oswego, Ill.

[73] Assignee: The United States of America as represented by the United States Department of Energy, Washington, D.C.

[21] Appl. No.: 641,222

[22] Filed: Aug. 16, 1984

[51] Int. Cl.[4] ..... F26B 3/10

[52] U.S. Cl. ..... 34/10; 34/57 E; 34/73; 34/76

[58] Field of Search ..... 34/54, 57 E, 73, 76, 34/10; 55/266, 269

[56] References Cited

U.S. PATENT DOCUMENTS

| | | | |
|---|---|---|---|
| 3,407,510 | 10/1968 | Lewis et al. . | |
| 3,418,724 | 12/1968 | Futer . | |
| 3,526,483 | 9/1970 | Deussner et al. . | |
| 3,600,817 | 8/1971 | Klein . | |
| 3,789,513 | 2/1974 | Mark . | |
| 3,851,404 | 12/1974 | Fracke et al. . | |
| 3,853,047 | 12/1974 | Dollbaum . | |
| 3,922,151 | 11/1975 | Kiss et al. | 55/269 |
| 3,922,796 | 12/1975 | Stephanoff . | |
| 3,974,574 | 8/1976 | Van Vliet et al. . | |
| 4,026,037 | 5/1977 | Buchholz . | |
| 4,502,230 | 3/1983 | Commer et al. | 34/57 E |

OTHER PUBLICATIONS

AIRBELT brochure, distributed by Futerized Systems, Inc. of Hayward, Calif.

*Primary Examiner*—Albert J. Makay
*Assistant Examiner*—David W. Westphal
*Attorney, Agent, or Firm*—Hugh W. Glenn; Robert J. Fisher; Judson R. Hightower

[57] ABSTRACT

Apparatus for drying pulverized material utilizes a high enthalpy condensable vapor such as steam for removing moisture from the individual particles of the pulverized material. The initially wet particulate material is tangentially delivered by a carrier vapor flow to an upper portion of a generally vertical cylindrical separation drum. The lateral wall of the separation drum is provided with a plurality of flow guides for directing the vapor tangentially therein in the direction of particulate material flow. Positioned concentrically within the separation drum and along the longitudinal axis thereof is a water-cooled condensation cylinder which is provided with a plurality of collection plates, or fins, on the outer lateral surface thereof. The cooled collection fins are aligned counter to the flow of the pulverized material and high enthalpy vapor mixture to maximize water vapor condensation thereon. The condensed liquid which includes moisture removed from the pulverized material then flows downward along the outer surface of the coolant cylinder and is collected and removed. The particles travel in a shallow helix due to respective centrifugal and vertical acceleration forces applied thereto. The individual particles of the pulverized material are directed outwardly by the vortex flow where they contact the inner cylindrical surface of the separation drum and are then deposited at the bottom thereof for easy collection and removal. The pulverized material drying apparatus is particularly adapted for drying coal fines and facilitates the recovery of the pulverized coal.

20 Claims, 2 Drawing Figures

DRYING OF PULVERIZED MATERIAL WITH HEATED CONDENSIBLE VAPOR

CONCTRACTUAL ORIGIN OF THE INVENTION

The United States Government has rights in this invention under Contract No. W-31-109-ENG-38 between the U.S. Department of Energy and Argonne National Laboratory.

BACKGROUND OF THE INVENTION

This invention relates generally to the drying of pulverized materials and is particularly directed to the drying of a pulverized material by means of a heated condensable vapor at relatively low pressure in combination with a vapor sink to separate and remove the moisture from the pulverized material.

Drying mills adapted to receive wet pulverized material in particulate form, such as in a slurry or the like, are commonly used to dry a wide range of materials such as grains, seeds, sand and coal. The wet particles are fed into one end of an inlet chamber, preferably in the form of an atomized spray, and are entrained in a typically hot gaseous fluid. As the particles are entrained in the hot angularly directed gases, they are centrifugally whirled through a generally arcuate path leading from the inlet chamber. During their travel with the hot gases in this generally arcuate path, a large portion of the particles are completely dried while some are only partially dried. The lighter, completely dried particles are displaced around an inner portion of the centrifugal path, while the heavier, wetter particles whirl around an outer portion of the centrifugal path. Such systems frequently include a classification section wherein, as the particles transit the apparatus, the lighter particles in the inner centrifugal portion pass through an exhaust port while the heavier particles continue down the inlet chamber where they are mixed with newly introduced pulverized material and are again entrained by the hot gaseous fluid and recycled through the drying mill.

The hot treatment gas is typically introduced tangentially into a cylindrical chamber and travels in a helical path along the longitudinal direction thereof. The raw, moist material is fed into the gas flow and is thereby subjected to a centrifugal force field within the chamber. The dust-like product thus subjected to the centrifugal force field advances through the hot treatment gas in a spiraling path following the gas flow and moving transversely, or in a cross-current, to the hot treatment gas from the interior of the cylindrical chamber toward the outside thereof to the chamber wall. The chamber wall is generally provided with an opening at one end thereof through which the preheated or chemically treated material is discharged from the cylindrical chamber. The transverse flow direction, or cross-current guidance, of the heated material and gas mixture results in higher heat exchanges than available with a simple direct flow arrangement. The kinetic and thermal energy present at the entrance end of the cylindrical chamber thus serves essentially to accelerate, disperse, and preheat the particles of material, whereas the gas flow at the exit end of the cylindrical chamber functions primarily to raise the temperature of the pulverized material in removing moisture therefrom. This type of drying apparatus utilizes the so-called tornado-flow principle and is generally termed a rotationally symmetrical vortex chamber.

Attempts to use the cyclonic flow devices described above in the processing of coal fines have met with limited success. In a coal drying operation, the particles are so small that they become entrained within the gas flow and escape the rotationally symmetrical vortex chamber at the gas outlet and require a subsequent cyclonic flow stage or two for separation from the effluent gas. Separation could also be accomplished by means of a water scrubber spray. However, this approach would put the coal particles in the same form as provided to the rotationally symmetrical vortex chamber, i.e., in a wet slurry or partially dried agglomeration. In fact, the coal dust is typically originally recovered from the combustion exhaust gases by means of a water scrubber spray. Thus, the use of a conventional rotationally symmetrical vortex chamber would result in an endless cycle and would be of little practical use in the recovery processing of coal fines.

Following combustion gas heating of the coal, the fine coal dust is recovered from the combustion exhaust gases typically by means of a water scrubber spray as described above. This process produces a wet slurry typically comprised of approximately 80% water. The slurry is then allowed to dry primarily by evaporation which reduces its moisture content to approximately 40%. However, in order to be commercially usable, the moisture content within the coal fines must be less than 10%. To date, there is no efficient means or method available for reducing the moisture content of coal fines down to commercially usable levels.

Therefore, the present invention is intended to provide an efficient and effective means and method for removing substantially all of the moisture from coal fines in producing commercially usable coal. While disclosed primarily as related to the drying of coal fines, the present invention is not limited to such applications and may be used equally as well for drying substantially any pulverized material efficiently and at low cost.

OBJECTS AND SUMMARY OF THE INVENTION

Accordingly, it is an object of the present invention to provide an improved method and arrangement for drying pulverized materials.

It is another object of the present invention to provide for the removal of moisture from a pulverized material by mixing the material with a heated condensible vapor and separating out the thus removed moisture by condensation.

Yet another object of the present invention is to provide for the drying of material in particulate form using a high enthalpy steam at low, e.g., atmospheric, pressures in combination with a vapor sink and particle displacement and collection means.

Still another object of the present invention is to dry a pulverized material such as coal fine using a cool entrapment surface for entrapping and condensing the steam and moisture removed from the material in a steam drying apparatus.

A further object of the present invention is to mix a moist pulverized material with a heated condensible vapor and to separate the pulverized material from the condensible vapor as well as the moisture removed from the material particles in providing for the drying thereof.

A still further object of the present invention is to provide an inexpensive means and method for drying moist coal fines.

Another object of the present invention is to provide a method and apparatus for drying moist particulate materials in a more rapid and efficient manner than available in conventional drying systems.

The present invention contemplates a means and method for drying and recovering pulverized materials, such as coal fines. The initially wet pulverized material is tangentially delivered by a condensible carrier vapor flow to an upper portion of a generally vertical cylindrical separation drum. The lateral wall of the separation drum is provided with a plurality of directed flow guides for introducing a high enthalpy condensible vapor such as steam into the separation drum tangentially in the direction of flow of the pulverized material. Concentrically positioned within the separation drum along the axis thereof is a water cooled condensation cylinder which includes a plurality of collection fins on the outer lateral surface thereof. The cooled collection fins are aligned counter to the helical downward flow of the pulverized material and heated vapor mixture.

The vapor used for drying as well as the moisture liberated from the wet particles migrates via the collection fins to the cold surface of the condensation cylinder due to differential vapor pressure and flows down the side of the condensation cylinder where it is collected and removed from the system. Capillarity maintains the condensed liquid between the collection fins and the condensation cylinder with the upstream alignment of the collection fins preventing re-entrainment of the liquid. The individual particles of the pulverized material are directed outward by the downward, helical vortex flow where they contact the inner cylindrical surface of the separation drum and drop downward. The free particles travel in a shallow helix due to respective centrifugal and vertical acceleration forces applied thereto. The dried pulverized material exits the conical bottom of the apparatus assisted, if necessary, by a vibratory accessory. The pulverized material drying apparatus is particularly adapted for drying coal fines using steam as the high enthalpy vapor and facilitates the recovery of the pulverized coal.

BRIEF DESCRIPTION OF THE DRAWINGS

The appended claims set forth those novel features which characterize the invention. However, the invention itself, as well as further objects and advantages thereof, will best be understood by reference to the following detailed description of a preferred embodiment taken in conjunction with the accompanying drawings, where like reference characters identify like elements throughout the various figures, in which:

DETAILED DESCRIPTION OF PREFERRED EMBODIMENTS

Figure 1:
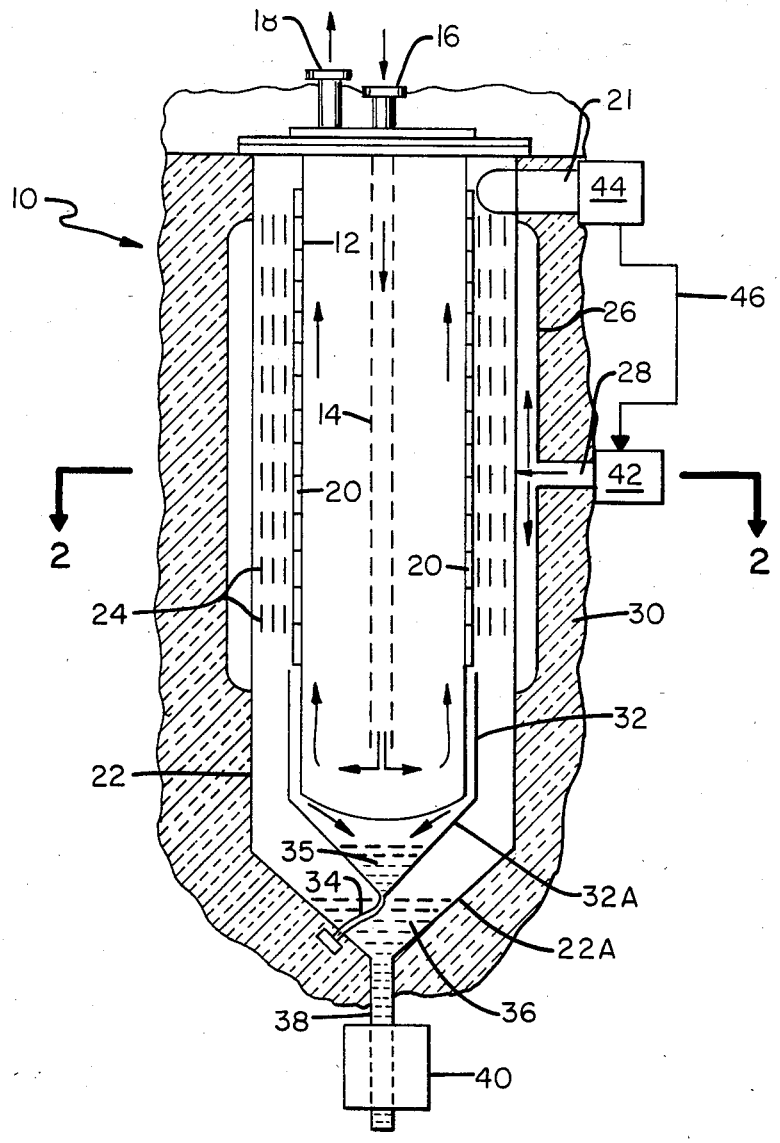
FIG. 1 is a partially cutaway vertical sectional view of an apparatus for the drying of pulverized material with a heated condensible vapor in accordance with the principles of the present invention.

Referring to FIG. 1, there is shown a vertical sectional view in simplified schematic form of a material drying apparatus 10 in accordance with the present invention.

The material drying apparatus 10 includes a generally vertically aligned, cylindrical separation drum 22. Coaxially positioned around the lateral wall of the cylindrical separation drum 22 and in contact therewith is a steam manifold 26 which extends along the length of the cylindrical separation drum 22. A high enthalpy condensible vapor, such as steam, is introduced into the manifold 26 via an inlet duct 28 coupled to a vapor source and controller 42 and passes via a plurality of flow guides 24 as described below into the separation drum 22. The combination of the cylindrical separation drum 22 and the manifold 26 is enclosed within a layer of insulation 30.

Coaxially positioned within the cylindrical separation drum 22 and aligned along the length thereof is a coolant cylinder 12. Coupled to an upper portion of the coolant cylinder 12 is a water inlet 16 and a water outlet 18. Positioned coaxially within and along the axis of the coolant cylinder 12 is a water flow tube 14 which is coupled to and continuous with the water inlet 16. A continuous flow of cold water is directed into the coolant cylinder 12 via the water inlet 16 and the water flow tube 14. The cold water circulates within the coolant cylinder 12 and exits therefrom via the water outlet 18. In this manner, the coolant cylinder 12 is maintained at a relatively low temperature to permit the vapor introduced into the cylindrical separation drum 22 from the manifold 26 to condense upon the outer, lateral surface of the coolant cylinder 12.

Figure 2:
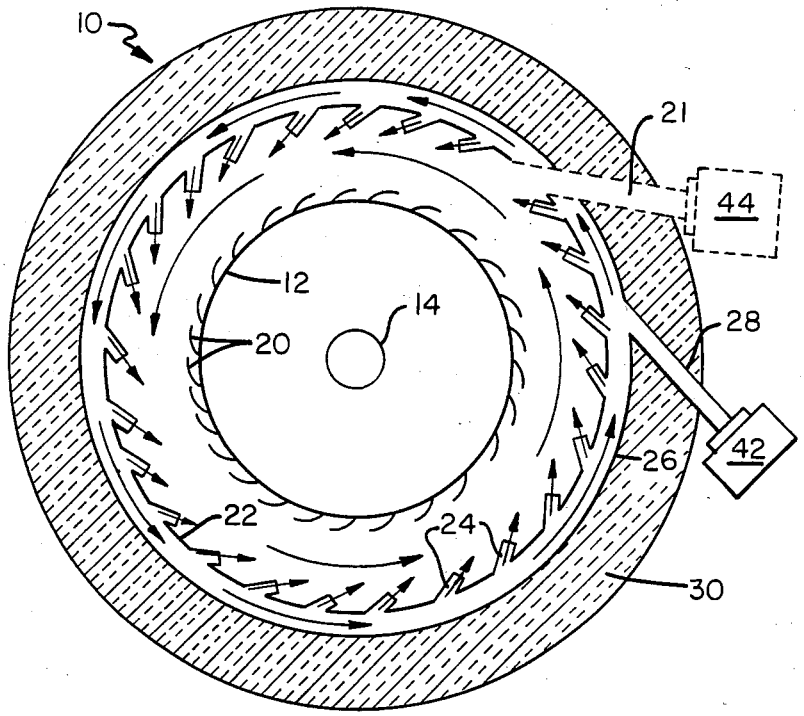
FIG. 2 is a horizontal sectional view of the pulverized material drying apparatus of FIG. 1 taken along sight line 2—2 therein.

Coupled to an upper portion of the cylindrical separation drum 22 by means of a particulate material feed 21 is a pulverized material source and sensor 44. The pulverized material source 44 directs a moist pulverized material into the cylindrical separation drum 22 via the particulate material feed 21 in a manner such that the pulverized material moves downward within the cylindrical separation drum 22 in a generally helical or spiral path. This is accomplished, as shown in FIG. 2 which is a sectional view of the material drying apparatus 10 of FIG. 1 taken along sight line 2—2 therein, by orienting the particulate material feed 21 generally tangentially with respect to the cylindrical separation drum 22. In this manner, the pulverized material is directed in a counterclockwise rotational displacement path around the coolant cylinder 12 and within the cylindrical separation drum 22 as shown by the direction of the arrows in FIG. 2. The particulate material feed 21 is shown in phantom in FIG. 2 as it is positioned above the inlet duct 28 in a preferred embodiment as shown in FIG. 1.

The inner lateral surface of the cylindrical separation drum 22 is provided with a plurality of tangential flow guides 24 shown merely as an array of slots in FIG. 1 for simplicity, but shown in greater detail in FIG. 2. From FIG. 2, it can be seen that each of the flow guides 24 extends into and is aligned generally tangentially with respect to the lateral wall of the cylindrical separation drum 22. It can be further seen from FIG. 2 that the inlet duct 28 is similarly oriented generally tangentially with respect to the lateral wall of the cylindrical separation drum 22. By introducing a heated, or high enthalpy, condensible vapor via the tangentially oriented inlet duct 28, the vapor circulates within the manifold 26 in a counterclockwise direction as shown by the arrows in FIG. 2. As the vapor circulates within the manifold 26, it is exhausted via the tangential flow guides 24 into the cylindrical separation drum 26 in the direction of flow of the particulate material introduced therein via the particulate material feed 21. The pulverized material would typically be mixed with a condensible vapor such as steam within the pulverized material source and senser 44 to facilitate its entry into and helical flow within the cylindrical separation drum 22. The pulverized material will be displaced in a counterclockwise direction as shown by the arrows in FIG. 2 and will travel downward in a spiraling, or helical, manner toward the lower portion of the cylindrical separation drum 22.

The outer, lateral surface of the coolant cylinder 12 is provided with a plurality of collection fins, or plates, 20 extending along a portion of the length thereof. As shown in FIG. 2, the collection fins are aligned generally counter to the direction of flow of the pulverized material and vapor mixture and are maintained at a lowered temperature by means of the coolant cylinder 12 to which they are attached. The collection fins 20 are configured so as to entrap vapor which condenses on the concave surface thereof. The direction of flow of the pulverized material and vapor mixture within the cylindrical separation drum 22, causes the condensed vapor to migrate to the cold outer surface of the coolant cylinder 12 due to differential vapor pressure. Capillary action maintains the thus condensed liquid between the collection fins 20 and the outer lateral surface of the coolant cylinder 12. By orienting the curved collection fins 20 counter to the flow of the pulverized material and vapor mixture, re-entrainment of the liquid which collects on the collection fins 20 and the coolant cylinder 12 is precluded. In a preferred embodiment the collection fins 20 are comprised of a plurality of overlapping curvilinear metal plates aligned along the length of the coolant cylinder 12. Each individual plate may be provided with a slit therein to accommodate the differential temperature distribution therein and associated relative expansion thereof. In another embodiment, each collection fin 20 may be in the form of a continuous curved strip extending along the length of the coolant cylinder 12.

As the helically displaced pulverized material moves downward through the drying zone within the cylindrical separation drum 22, additional moisture is removed from the individual particles by the heated vapor introduced into the cylindrical separation drum 22 via the tangential flow guides 24. The particles are thus subjected to centrifugal as well as vertical acceleration forces and tend to move toward the outer lateral wall of the cylindrical separation drum 22 as they lose more moisture. Eventually the substantially dried pulverized material will strike the outer wall of the cylindrical separation drum 22 and drop to the bottom of the cylindrical separation drum 22 in the form of deposited particulate material 36. The alignment of the tangential flow guides 24 in the cylindrical separation drum 22 with the direction of flow therein minimizes the possibility of the pulverized material collecting on the inner lateral wall of the separation drum 22 and clogging the tangential flow guides 24. The vapor collected on the outer lateral wall of the coolant cylinder 12 includes not only the moisture removed from the particulate material, but also the condensible vapor introduced into the cylindrical separation drum 22 from the manifold 26 and the condensible vapor which is initially mixed with the particulate material in the pulverized material source and sensor 44. The heated vapor possesses a high enthalpy and is preferably in a superheated form to facilitate removal of the moisture from the pulverized material. As the condensed vapor collects upon the outer surface of the coolant cylinder 12, this liquid flows downward along the length thereof in between adjacent collection fins 20 and is deposited in a moisture collector 32 positioned around a lower portion of the coolant cylinder 12. The moisture collector 32 includes a concave lower portion 32A which is coupled to a moisture drain 34 to facilitate removal from the material drying apparatus 10 of the moisture extracted from the moist pulverized material.

The lower portion of the cylindrical separation drum 22 is similarly provided with a concave lower portion 22A within which the dried pulverized material is deposited and collects. The concave lower portion 22A of the cylindrical separation drum 22 is provided with an aperture which leads to an outlet 38 for the removal of the dried pulverized material from the material drying apparatus 10. In order to facilitate removal of the dried pulverized material, a conventional vibratory device 40 may be coupled to the outlet 38.

As indicated above, a vapor, such as steam, is used as a pneumatic carrier for introducing the pulverized material from the pulverized material source and sensor 44 via the particulate material feed 21 into the cylindrical separation drum 22. The temperature of the vapor used as the pneumatic carrier may be less than the temperature of the vapor introduced into the cylindrical separation drum 22 via the tangential flow guides 24 for extracting the moisture from the pulverized material. The high enthalpy vapor introduced via the tangential flow guides 24 exerts an aerodynamic drag on the individual particles of the pulverized material as they are displaced outwardly from the coolant cylinder 12 in the cylindrical separation drum 22. In order to proportion this aerodynamic drag with the centrifugal force exerted upon the individual particles, a vapor source and controller 42 is coupled to the pulverized material source and sensor 44 via a line 46. By detecting the amount of vapor and pulverized material introduced into the cylindrical separation drum 22 which determines the helical displacement trajectory of the individual particles, the vapor source and controller 42 adjusts the heated vapor flow provided to the cylindrical separation drum 22 to permit the individual particles to migrate outwardly toward the outer wall of the cylindrical separation drum 22 at such a rate as to maximize the moisture extraction from the particles. The vapor source and controller 42 and the pulverized material source and sensor 44 are shown simply in the form of blocks in the figures as they may be conventional in nature and as such are well known to those skilled in the relevant arts.

There has thus been shown a method and apparatus for drying pulverized material by injecting a high enthalpy condensible vapor in a helical vortex flow of the pulverized material within a confined volume. A vapor sink in the form of cooled entrapment surfaces is used to entrap the condensed vapor and moisture removed from the particles. The pulverized material particles are allowed to descend through a drying zone into which the heated vapor is injected, with the recovered moisture and dried particles separately collected and removed from the apparatus. A preferred embodiment of the present invention is intended for use in the drying of coal fines using superheated steam injected into a cylindrical separation drum at essentially atmospheric pressure for drying the pulverized coal particles.

While particular embodiments of the present invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

The embodiments of the invention in which an exclusive property or privilege is claimed are defined as follows:

1. A method of drying moist particles comprising the steps of:

causing a stream of the moist particles to flow in a shallow spiral downwardly about a vertical axis within a drying zone;

injecting a high enthalpy condensible vapor into the stream of particles at a plurality of points at an outer periphery of the spiral to form an atmosphere of heated vapor and remove moisture from the moist particles;

providing a plurality of cooled entrapment surfaces within the spiral, said cooled entrapment surfaces aligned in a direction opposing the spiral flow of said particles for entrapping said vapor and moisture removed from the particles and forming condensate therefrom;

removing said condensate from said entrapment surfaces; and removing the particles having a reduced moisture content from the drying zone.

2. The method of claim 1 further comprising the step of heating said vapor above its saturation temperature prior to injecting said vapor into said stream of particles.

3. The method of claim 1 wherein said plurality of cooled entrapment surfaces are contoured so as to prevent the re-entrainment of said condensate.

4. The method of claim 1 further comprising the step of cooling said entrapment surfaces by circulating a coolant liquid in contact therewith.

5. The method of claim 1 wherein said drying zone is generally cylindrical and wherein the step of causing a stream of moist particles to flow in a shallow spiral downwardly includes the step of directing said stream of moist particles tangentially into said cylindrical drying zone in generating said spiral flow.

6. The method of claim 5 wherein said vapor is directed tangentially into said cylindrical drying zone in the direction of the spiral flow of said particles.

7. The method of claim 1 further comprising the step of directing the condensate to one end of said drying zone for removal therefrom by gravity.

8. The method of claim 1 further comprising the step of vibrating the particles having a reduced moisture content to facilitate their removal from said drying zone.

9. The method of claim 1 wherein the step of causing a stream of moist particles to flow in a shallow spiral includes mixing said particles with said vapor prior to entry in said drying zone.

10. The method of claim 1 wherein said high enthalpy vapor is superheated steam.

11. The method of claim 1 further comprising the step of balancing the inwardly directed force exerted on said particles by said vapor with the centrifugal force exerted upon the particles in their spiral displacement by controlling the rate of injection of said vapor to permit said particles to travel to an outer portion of said drying zone and to spiral downward.

12. Apparatus for drying a moist pulverized material comprising:

a generally vertically oriented cylindrical separation drum having a generally circular outer lateral wall;

feeder means having a lateral wall and coupled to an upper portion of said separation drum for directing the moist pulverized material into said separation drum generally tangentially to the lateral wall thereof wherein said pulverized material travels downward in a generally helical path in said separation drum;

a vapor source coupled to the lateral wall of said separation drum for directing a heated condensible vapor therein in the direction of travel of said pulverized material, wherein said heated vapor interacts with said pulverized material to remove moisture therefrom;

condensation means position within said separation drum for collecting said vapor and the thus removed moisture, said condensation means including a plurality of cooled collection plates extending into the moving vapor and pulverized material mixture; and means coupled to a lower portion of said separation drum for collecting and removing the thus dried pulverized material therefrom.

13. The apparatus of claim 12 further comprising means coupled to a lower portion of said condensation means for removing said vapor and moisture from said separation drum.

14. The apparatus of claim 12 wherein said outer lateral wall of said separation drum includes a plurality of generally tangential flow guides coupled to and continuous with said vapor source for directing said vapor generally tangentially to said lateral wall and in the direction of travel of said pulverized material.

15. The apparatus of claim 12 wherein said condensation means further includes a water cooled chamber positioned in a center portion of said separation drum.

16. The apparatus of claim 15 wherein said plurality of collection plates are mounted on said water cooled chamber.

17. The apparatus of claim 12 wherein said collection plates are curvilinear and are aligned on said water cooled chamber in a direction opposing the direction of travel of said vapor and pulverized material mixture.

18. The apparatus of claim 12 further comprising vibrating means coupled to a lower portion of said separation drum for facilitating the removal of said pulverized material therefrom.

19. The apparatus of claim 12 further comprising means coupled to said feeder means for mixing said moist pulverized material with a carrier vapor for facilitating the delivery of said pulverized material therein.

20. The apparatus of claim 19 wherein said carrier vapor is condensible and collects on said condensation means.

* * * * *